US007204486B2

(12) United States Patent
Tanabe

(10) Patent No.: US 7,204,486 B2
(45) Date of Patent: Apr. 17, 2007

(54) SHEET DISCHARGING APPARATUS

(75) Inventor: Tsuyoshi Tanabe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 352 days.

(21) Appl. No.: 10/812,065

(22) Filed: Mar. 30, 2004

(65) Prior Publication Data

US 2004/0188928 A1 Sep. 30, 2004

(30) Foreign Application Priority Data

Mar. 31, 2003 (JP) ..... 2003-096482

(51) Int. Cl.
*B65H 5/02* (2006.01)

(52) U.S. Cl. ..... 271/272; 271/270

(58) Field of Classification Search ..... 271/270, 271/272, 202, 116, 256
See application file for complete search history.

(56) References Cited

U.S. PATENT DOCUMENTS 4,526,361 A * 7/1985 DuBois ..... 271/186
4,569,514 A * 2/1986 Holtje ..... 271/314
5,156,390 A * 10/1992 Nagao et al. ..... 271/202
5,446,520 A * 8/1995 Todoki ..... 355/27
5,724,626 A 3/1998 Todoki
5,749,569 A * 5/1998 Atsumi et al. ..... 271/10.11
5,901,950 A * 5/1999 Kobayashi et al. ..... 271/3.24
6,135,448 A 10/2000 Daito
6,179,495 B1 * 1/2001 Sugata et al. ..... 396/612
6,530,569 B2 * 3/2003 Yamagishi ..... 271/270

FOREIGN PATENT DOCUMENTS

JP 58119526 A * 7/1983
JP 07-005671 B2 1/1995
JP 2765652 A 5/1997
JP 3286598 A 12/1999

* cited by examiner

*Primary Examiner*—Patrick Mackey
*Assistant Examiner*—Matthew J. Kohner
(74) *Attorney, Agent, or Firm*—Sughrue Mion, PLLC

(57) ABSTRACT

A sheet discharging apparatus is constructed of a sorting device and a reversible conveying device. Normal sheets are fed by the sorting device and conveyed in an arrangement in zigzag in two rows and conveyed on a primary path. Near an exit of the primary path, there is a high speed discharging roller pair having a drive roller and a nip roller. Between the drive roller and a drive shaft, there is a frictional connection unit. While the sheet is conveyed by conveying roller pairs, a front edge of the sheet reaches the high speed discharging roller pair, and the drive roller freely rotates due to the effect of the frictional connection unit. When a rear edge of the sheet passes the conveying roller pair, the frictional connection unit is set into a connecting situation, and the sheet is discharged by the drive roller and the nip roller.

8 Claims, 9 Drawing Sheets

SHEET DISCHARGING APPARATUS

BACKGROUND OF THE INVENTION

1. Field of the Invention

The present invention relates to a sheet discharging apparatus used in a printer processor, an automatic development system, an image recording apparatus and the like, and particularly to a sheet discharging equipment for discharging recording sheets arranged in zigzag among rows so as to align in one row.

2. Description Related to the Prior Art

In a printer processor used in a photo laboratory is used a paper roll in which a continuous photosensitive recording paper is rolled. The photosensitive recording paper which is advanced from the paper roll is cut into recording sheets, and each recording paper is exposed so as to form an image. In the printer processor, thereafter, the recording sheet is transported to a development device in which the development and the fixation are made and a dryer in which the drying is made. As the recording sheet, there are a photosensitive recording sheet, normal paper sheet, and the like. And the recording sheet is simply called a sheet.

Compared with the exposing treatment for exposing and recording the image, a long time period is necessary to perform the developing treatment of one sheet in the development device, since during the developing treatment the sheet is conveyed through processing tanks which respectively contain water and processing liquids for color development, bleaching, fixation, wash, and stabilization. Accordingly, before the developing treatment in the development device, plural exposed sheets are dispensed so as to lie in zigzag in the plural rows in the conveying path such that the sheet of the latter exposure may be positioned behind that of the former exposure. Then the exposed sheets are conveyed to the development device. As the development is made after the zigzag arrangement of the sheets in plural rows on the conveying path, the facility of the treatment becomes larger in the same treatment period. Further, the sheet after the developing treatment is conveyed with the arrangement in the plural rows on the conveying path, and supplied in the dryer. In the dryer, an air heated by a heater is blown with fans so as to dry the sheet.

Otherwise, after the developing treatment and the drying treatment, the sheets discharged in plural rows as described above are gathered into a dispenser with the arrangement in a single row of the sheets in the order of the exposure. For example, Japanese Patents No. 3286598 (Pages 1–2), 2812143 (Pages 1–2), 2765652 (Pages 2–4), and Japanese Patent Publication No. 60-23343 (Page 1) describe a sheet discharging apparatuses, in each of which the sheets conveyed in the plural rows are discharged and arranged in a single row in the order of the exposure.

In the sheet discharging apparatus described in the publications, there are a conveying path for conveying the plural sheets arranged in plural rows, a discharging means which is disposed near an entrance of the conveying path and discharges out at a high speed the sheets conveyed in the plural rows, and a conveyer whose endless belt continuously shifts in a direction perpendicular to the discharging direction of the discharging means and surmounts the sheets discharged by the discharging means. When the sheets are surmounted on the belt, they reach sequentially in the order of the exposure, and therefore they are conveyed on the endless belt in the single row.

In such sheet discharging apparatus, when the sheet is discharged at a high speed to the endless belt by the discharging means, the rear edge of the sheet is nipped by a roller pair for conveying the sheet in the plural rows, and there is a difference between the conveying speed of the roller pair and the discharging speed of the discharging means. Accordingly, in order to discharge at high speed to the endless belt, it is necessary to eliminate the difference. In the above publications No. 3286598 and 2812143, the sheet discharging apparatus is provided with a one-way clutch between a conveyer roller of the roller pair disposed along the plural rows and a shaft for coaxially supporting the conveyer rollers. When the discharging at the high speed to the endless belt is performed, the one-way clutch operates to release the conveyer roller from the driving system. Thus the conveyer roller freely rotates such that the sheet may smoothly leave the roller pair.

However, in order to eliminate the difference between the conveying speed of the conveying roller and the discharging speed by the discharging means in this structure of free rotation of the conveying roller by the effect of the one-way clutch, a large number of the one-way clutches is provided in accordance with the length variation of the cut sheet to be used in the above sheet discharging apparatus. As the one-way clutch is expensive, a low cost for production is difficult. Further, as the one-way clutch is attached to one roller of the conveyer roller pair, the roller nip force of the other roller of the conveyer roller pair is applied as a bending moment and an excess radial load to the one-way clutch and the conveyer roller, and therefore breaks the one-way clutch. Therefore, the durability of such a clutch is not so high.

In the publication No. 2765652, a torque limiter is provided between a drive shaft and a drive roller of a high speed discharging means. The torque limiter operates to freely rotate the drive roller, when a torque applied to the drive roller is at least a predetermined value. Thus the difference between the conveying speed of the conveyer roller and the discharging speed of the drive roller of the discharging means is eliminated. The drive roller is supported by a frame attached to the drive shaft. There is also a gear drive transmission mechanism between the drive roller and the drive shaft. Thus the drive force of the drive shaft is transmitted through the gear drive transmission mechanism and the torque limiter to the drive roller. Accordingly, the structure around the drive roller is complicated, the cost is high, and it is hard to keep the area for deposition of the parts. Further, the torque limiter is the so-called magnetic particle type, and therefore expensive, which make the cost higher. Furthermore, in the publication No 60-23343, a clutch mechanism which is constructed of a solenoid and a pair of clutch plates is used instead of the one-way clutch and the torque limiter. In this case, however, the number of the parts becomes larger, and many controlling means are necessary, which prevents decrease of the cost.

SUMMARY OF THE INVENTION

An object of the present invention is to provide a sheet discharging apparatus for discharging a sheet at a high speed with a discharging means, while a difference between a transporting speed on the conveying path and a discharging speed with the discharging means is eliminated.

Another object of the present invention is to provide a sheet discharging apparatus having a simple structure that can be produced in low cost.

In order to achieve the object and the other object, a sheet discharging apparatus of the present invention has a conveying means for conveying a sheet on a conveying path and a high speed discharging means for discharging out the sheet at high speed. The high speed discharging means is positioned near the exit, and a discharging speed is higher than a conveying speed of the conveying means. The high speed discharging means comprises a drive roller, a nip roller and a frictional connection unit. The drive roller is rotatably and coaxially attached to a drive shaft, and is unshiftable in an axial direction of the drive shaft. The nip roller contacts the drive roller, and rotates in accordance with rotation of the drive roller to nip the sheet with the drive roller. The frictional connection unit has the function of a friction clutch, and firmly couples the drive roller and the drive shaft by friction.

The frictional connection unit includes a fixing member fixed to the drive shaft and a friction member contacting a side surface of the drive roller that is perpendicular to the drive shaft. A biasing member is provided between the fixing member and the friction member, and biases the friction member to press the side surface of the drive roller.

In a preferred embodiment of the present invention, the friction member is provided with a contact portion for contacting the drive roller. The contact portion is chamfered to have an arc-shape or a linear inclination to an axial direction of the drive roller. The sheet is conveyed on said path in a situation that the sheets are positioned in zigzag in plural rows, and sequentially arranged in a single row after discharged by the discharging apparatus.

According to the sheet discharging apparatus of the present invention, the difference between the conveying speed of the conveying means and the discharging speed of the discharging means is eliminated in a simple structure and in low cost.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
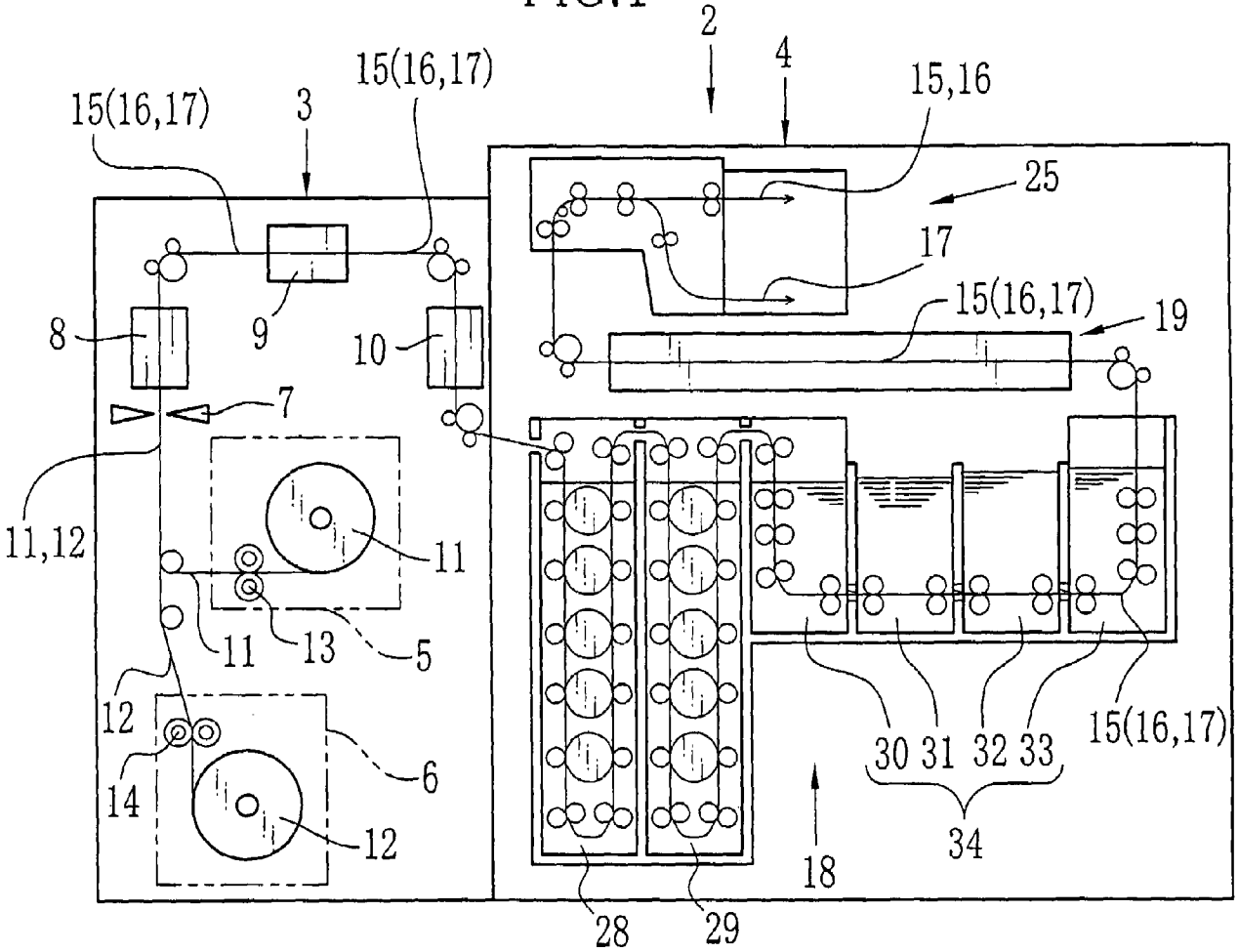
FIG. 1 is a schematic diagram of a printer processor including a sheet discharging apparatus of the present invention.

As shown in FIG. 1, a printer processor 2 is constructed of a printer section 3 and a processor section 4. The printer section 3 is constructed of magazines 5,6, a cutter 7, a back printer 8, an exposure device 9, and a sheet dispenser 10. The magazines 5,6 respectively contain rolls of color papers (hereinafter, papers) 11,12 having different width. When a feed roller 13 rotates, the paper 11 is drawn from the magazine 5, and the cutter 7 cuts the paper 11 in accordance with a print size to obtain a cut sheet paper, for example, a small size sheet 15 (see, FIG. 2A) having L-size (width 89 mm×length 127 mm), and a middle size sheet 16 (see, FIG. 2B) having 2L-size (width 127 mm×length 178 mm). When a feed roller 14 rotates, the paper 12 is drawn from the magazine 6, and the cutter 7 cuts the paper 12 in accordance with a print size to obtain the cut sheet paper, for example, a large size sheet 17 (see, FIG. 2C) having A4-size (width 210 mm×length 297 mm). Usually, when an order of the printing is made in the photofinisher, one of the print sizes of the sheets is selected such that the development may be effectively performed. Accordingly, the change of the print size is usually made corresponding to that of the order. Further, there are several print sizes in one order of the printing. In this case, the printing of the sheet of the same print size is continuously made.

In the back printer 8, information, such as a frame number, a correction data and the like, is printed on the rear surface of the sheet 15–17. In the exposure device 9, a laser printer already known is contained, and an exposure of the sheet 15–17 is made on the basis of the image data sent from an image reading device, or that memorized in a image data memory provided in the laser printer.

Figure 2A:
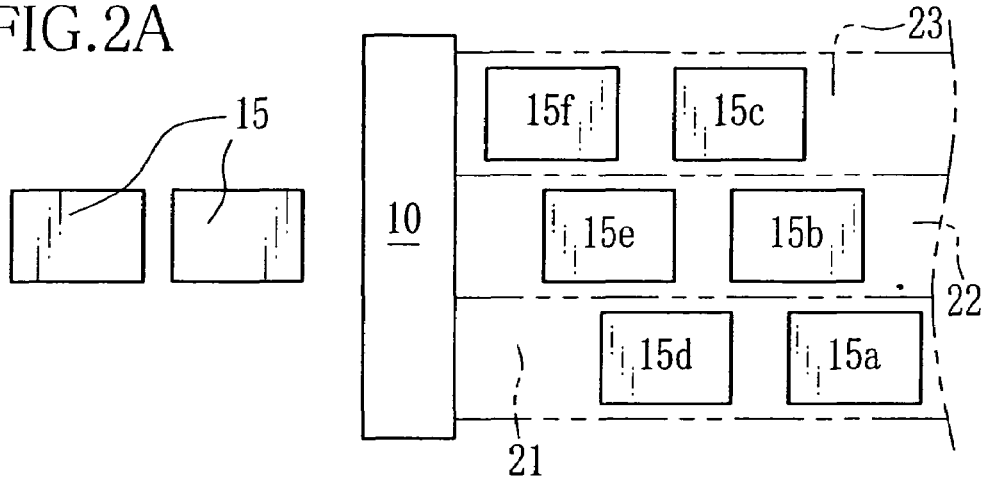
FIG. 2A is an explanatory view illustrating a situation of dispensing small size sheets with a sheet dispenser.
Figure 2B:
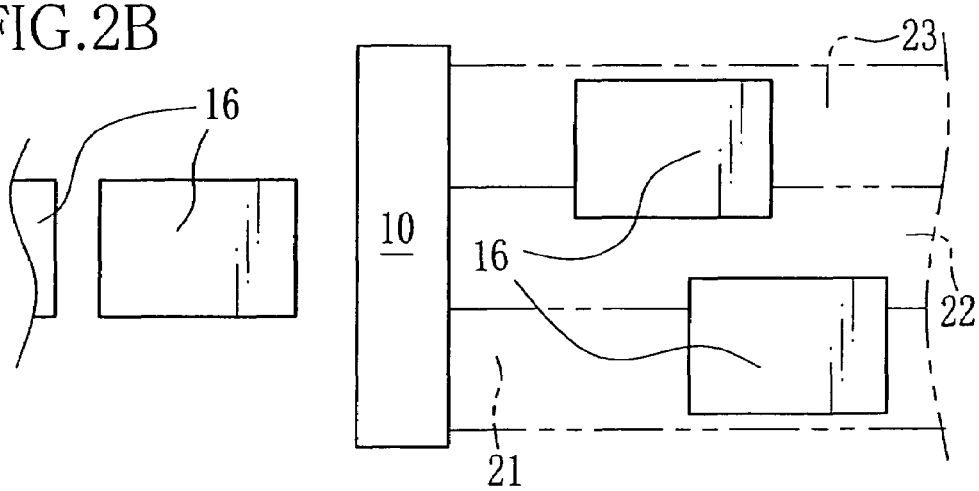
FIG. 2B is an explanatory view illustrating a situation of dispensing middle size sheets with the sheet dispenser.
Figure 2C:
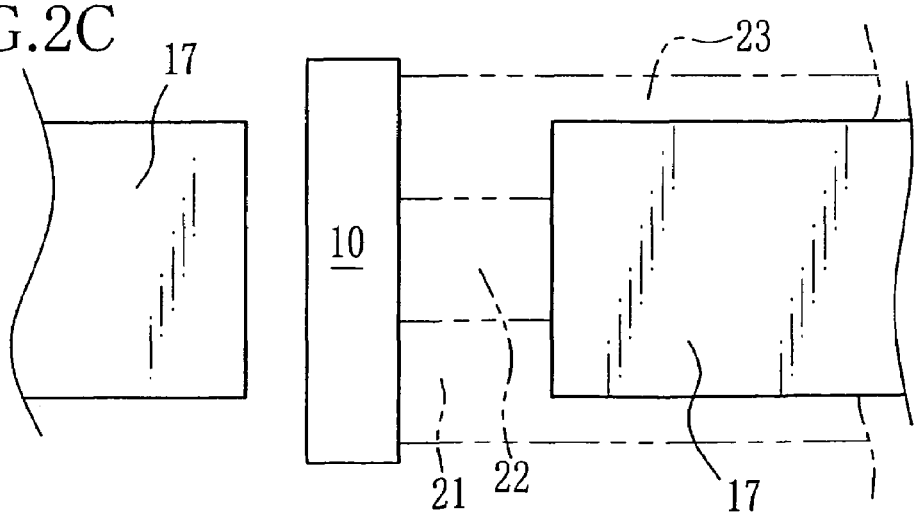
FIG. 2C is an explanatory view illustrating a situation of dispensing large size sheets with the sheet dispenser.

As shown in FIGS. 2A–2C, the sheet dispenser 10 dispenses the sheets 15–17 into one or plural rows in accordance with the sheet size. In this situation, each sheet 15–17 is sent to the development device 18 and the dryer 19.

As shown in FIG. 2A, the small size sheets 15 dispensed by the sheet dispenser 10 are arranged in zigzag, or in a regularly offset state as sheets 15*a*–15*f* on first-third conveying paths 21–23. At first the small size sheet 15*a* is dispensed to the first conveying path 21, secondly the small size sheet 15*b* to the second conveying path 22, and thirdly the small size sheet 15*c* to the third conveying path 23. Thereafter, the small size sheets 15*d*–15*f* are sequentially sorted to the first-third conveying paths 21–23. Since the small size sheets 15*a*–15*f* are sequentially sent to the sheet dispenser 10, the second small size sheet 15*b*, for example, is positioned in zigzag behind the first small size sheet 15*a* with difference of a half of the length of the small size sheet 15.

As shown in FIG. 2B, the middle size sheets 16 are dispensed in two rows and arranged in zigzag. One of the rows is on the first and second conveying paths 21, 22, and another one is on the second and third conveying paths 22, 23.

As shown in FIG. 2C, the large size sheet 17 is not dispensed but deposited and conveyed in one row over the first-third conveying paths 21–23.

In this embodiment, the sheet size of each small, middle and large size sheet is not restricted in the above description. The sheet having the width of 89 mm and the length of 82.5 mm to 254 mm is regarded as the small size sheet 15. The sheet having the width more than 89 mm and at most 152 mm and the length of at least 82.5 mm and at most 254 mm is regarded as the middle size sheet 16. The sheet having the width more than 152 mm and the length more than 254 mm is regarded as the large size sheet 17. However, in the present invention, the determination and the sort of the sheet size are not restricted in them. Further, the sheets having a peculiar sheet size, for example, a test print paper for management of exposure, a splice sheet which is cut off from the spliced paper, are regarded as the large size sheet 17. Further, after the magazines 5, 6 are set, a front end of the paper is cut off and conveyed. However, the front end is not used as a product for the photo print. Accordingly the front end is also transported with the same manner as the large size sheet.

After dispensed in one or plural rows by the sheet dispenser 10, the sheets 15–17 are conveyed to the development device 18 and the dryer 19 with keeping the arrangement pattern.

Figure 3:
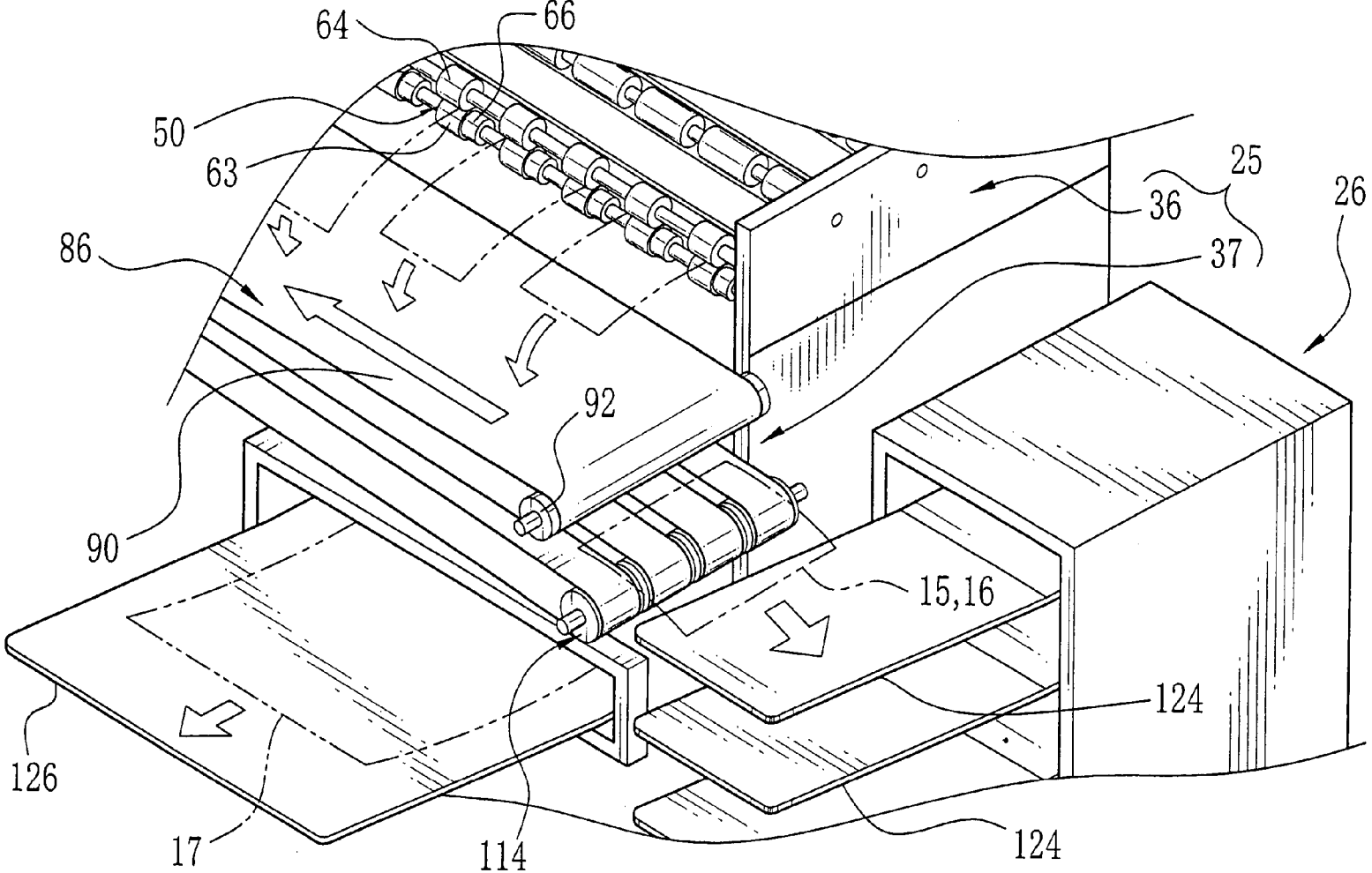
FIG. 3 is a perspective view from the side of an exit of the sheet discharging apparatus.

As shown in FIG. 1, the processor section 4 is constructed of the development device 18, the dryer 19, a sheet discharging apparatus 25, and a sorter 26 (see, FIG.3). The development device 18 is provided with a developing tank 28, a bleaching fixing tank 29 and first-fourth washing tanks 30–33 in this order from the upstream side of the convey of the sheets 15–17. The developing tank 28, the fixing tank 29 and the washing tanks 30–33 respectively contain a developing liquid, a fixing liquid and a washing water at a predetermined amount. The sheets 15–17 are conveyed through the developing, fixing and washing tanks 28–33 with a drive of a conveying rack provided in the developing, fixing and washing tanks 28–33, such that the development is performed. Note that submerged nipping devices are provided in the first-fourth washing tanks 30–33 through which the sheets 15–17 are conveyed horizontally. The conveying rack may have the nipping devices outside between the developing and the fixing tanks 28, 29.

The dryer 19 is disposed above the tanks 28–33, and constructed of a transporting belt and an air blowing duct (not shown). The air blowing duct feeds towards the transporting belt an air heated by a heater, so as to press each sheet to the transporting belt. In this situation that each sheet is conveyed on the transporting belt, each sheet is dried. The dried sheet is thereafter conveyed to the sheet discharging apparatus.

Figure 4:
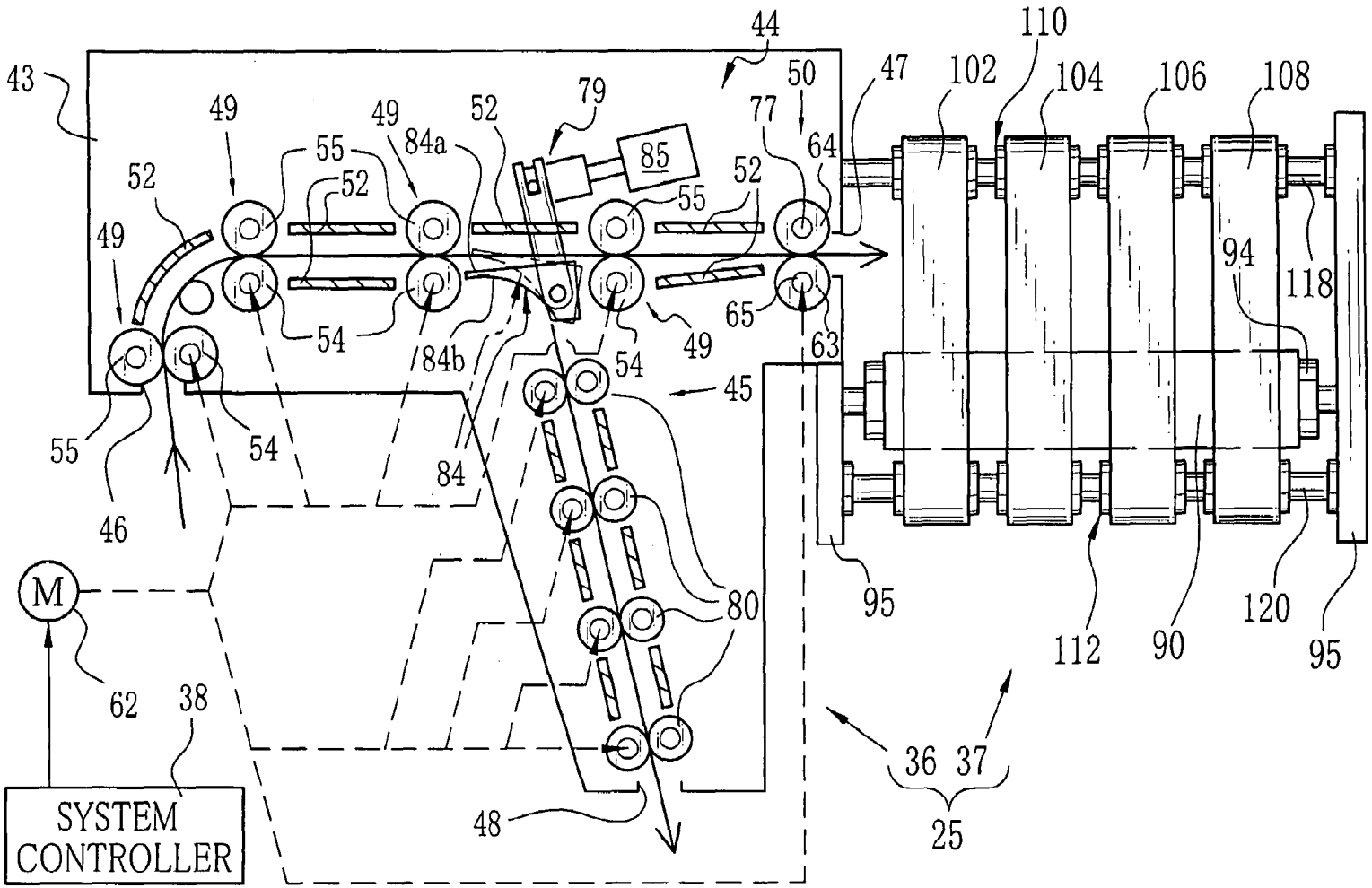
FIG. 4 is a schematic diagram of the sheet discharging apparatus.
Figure 5:
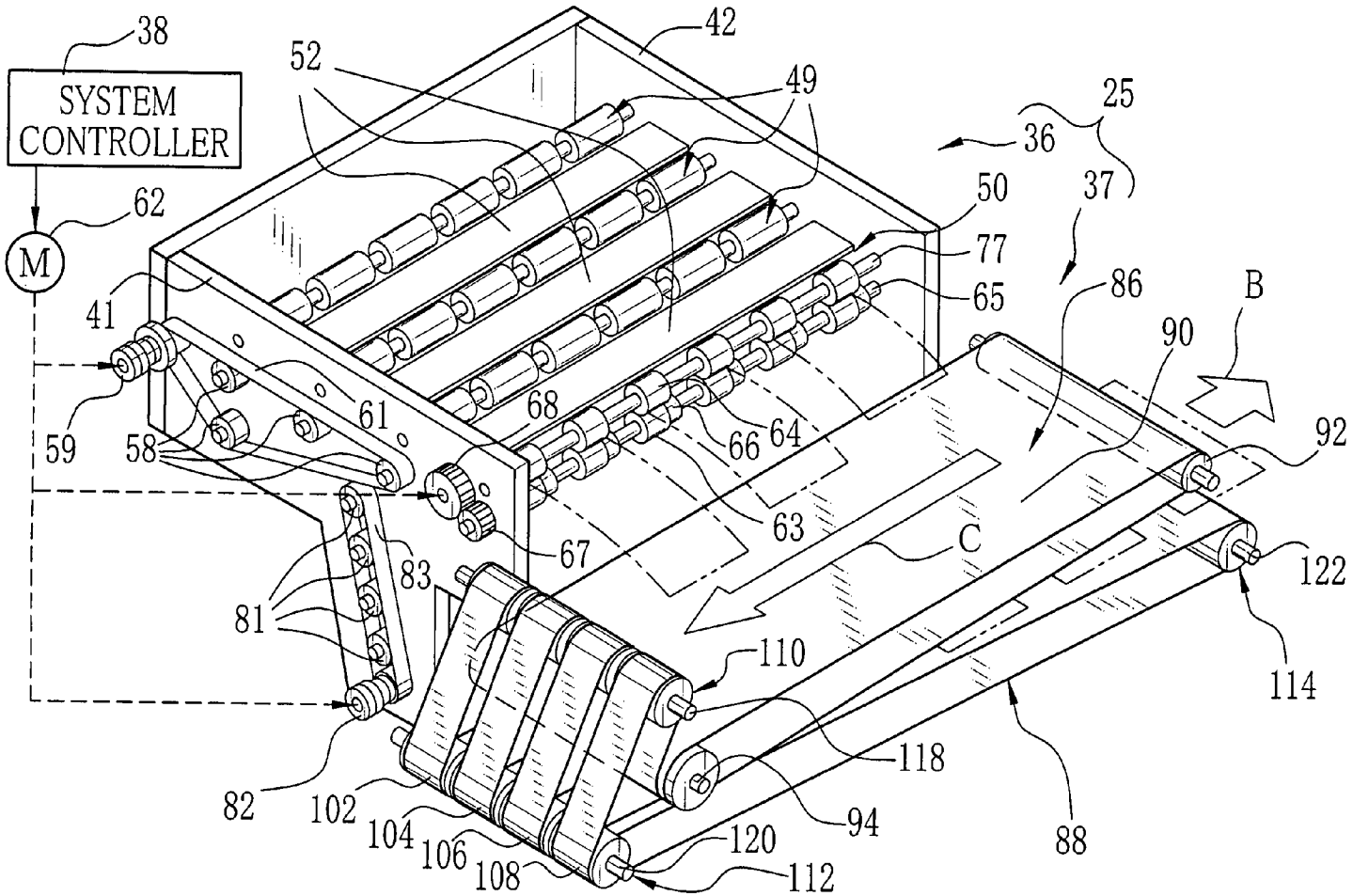
FIG. 5 is a perspective view from another side of the sheet discharging apparatus than FIG. 3.

As shown in FIGS. 3,4 and 5, the sheet discharging apparatus 25 is constructed of a sorting device 36 and a reversibly conveying device 37, and controlled by a system controller 38. The sorting device 36 includes a main body 43 having side plates 41, 42. In the main body 43, there are a primary path 44 and a secondary path 45. Note that the main body 43 has an upper plate for covering the inside of the main body 43, actually. However the upper plate is not illustrated for easiness of FIGS. 3, 4.

On a lower surface of the main body 43 is formed an entrance 46 through which enter the sheets 15–17 conveyed on the conveying paths 21–23 from the dryer 19. In an upper side of the main body 43, there is an exit 47 through which the small size sheet 15 or the middle size sheet 16 is discharged. In a lower side of the main body 43, there is an exit 48 through which the large size sheet 17 is discharged.

As shown in FIG. 4, there are plural conveying roller pairs 49 and a high speed discharging roller pair 50 on the primary path 44 between the entrance 46 and the exit 47. At first, the primary path 44 is directed upwards near the entrance 46, and curves so as to extend horizontally. The sheets 15, 16 are discharged in a horizontal direction from the exit 47 to the reversibly conveying device 37.

The conveying roller pairs 49 are arranged on the primary path 44 which is gradually curved from the upside toward the horizontal direction. Near the high speed discharging roller pair 50, the sheets 15, 16 are transported in the horizontal direction. Further, a conveying guide 52 is disposed around the primary path 44, such that the front edge of the sheet 15, 16 conveyed from the upstream side in the primary path 44 is guided to the conveying roller pairs 49 and the high speed discharging roller pair 50 downstream of the sheet. Thus the recoding sheet 15, 16 are smoothly nipped and conveyed.

The conveying roller pair 49 is constructed of a drive roller 54 and a nip roller 55. The drive roller 54 and the nip roller 55 are attached to respective metallic shaft, and both end portions of each shaft are supported by side plates 41, 42 (see, FIG. 5). The drive roller 54 may be formed from rubber and have a pillar shape. The nip roller 55 is formed from a synthetic polymer so as to have the almost same shape as the drive roller 54.

As shown in FIG. 5, one of the end portions of the shaft of each drive roller 54 is protruded from the side plate 41, and has a timing pulley 58 fixed thereto. A loop of a timing belt 61 surrounds the plural timing pulleys 58 and a pinion integrally formed with the drive shaft 59. Further, a rotation of a motor 62 as a source of a drive force is transmitted through a pin clutch to the drive shaft 59 to simultaneously rotate the drive rollers 54.

As shown in FIG. 4, the nip roller 55 is idly rotatable, and contacted to the drive roller 54 to rotate corresponding to rotation of the drive roller 54. Since the drive roller 54 and the nip roller 55 are paired as described above, the nip roller 55 rotates corresponding to rotation of the drive roller 54, and the sheet 15, 16 is nipped between the drive roller 54 and the nip roller 55 and conveyed in the primary path 44.

The high speed discharging roller pair 50 disposed near the exit 47 of the primary path 44 is constructed of a drive roller 63 and a nip roller 64. As shown in FIG. 5, the plural drive rollers 63 are rotatably and coaxially attached to a metallic shaft 65 with the same intervals between the neighboring drive rollers 63. It is to be noted in this figure that the number of the drive rollers 63 on the shaft 65 is six. There is a frictional connection unit (friction clutch) 66 between each drive roller 63 and the shaft 65.

Both end portions of the shaft 65 are supported by side plates 41, 42. One of the end portions of the shaft 65 is protruded from the side plate 41, and has a pinion 67 fixed thereto. The pinion 67 is meshed with a gear 68 having a larger diameter than the pinion. As the gear 68 is connected to the motor 62 through a pin clutch, a speed changer and the like can vary and regulate a rotational speed of the gear 68. Accordingly, the rotation of the gear 68 is controlled such that the rotational speed may be the same between the gear and each drive roller 54. Further, as the pinion 67 has the smaller diameter than the gear 68, the speed of rotation of the pinion 67 is higher than that of the gear 68. Therefore, the shaft 65 rotates at higher speed than the drive rollers 54.

Figure 6:
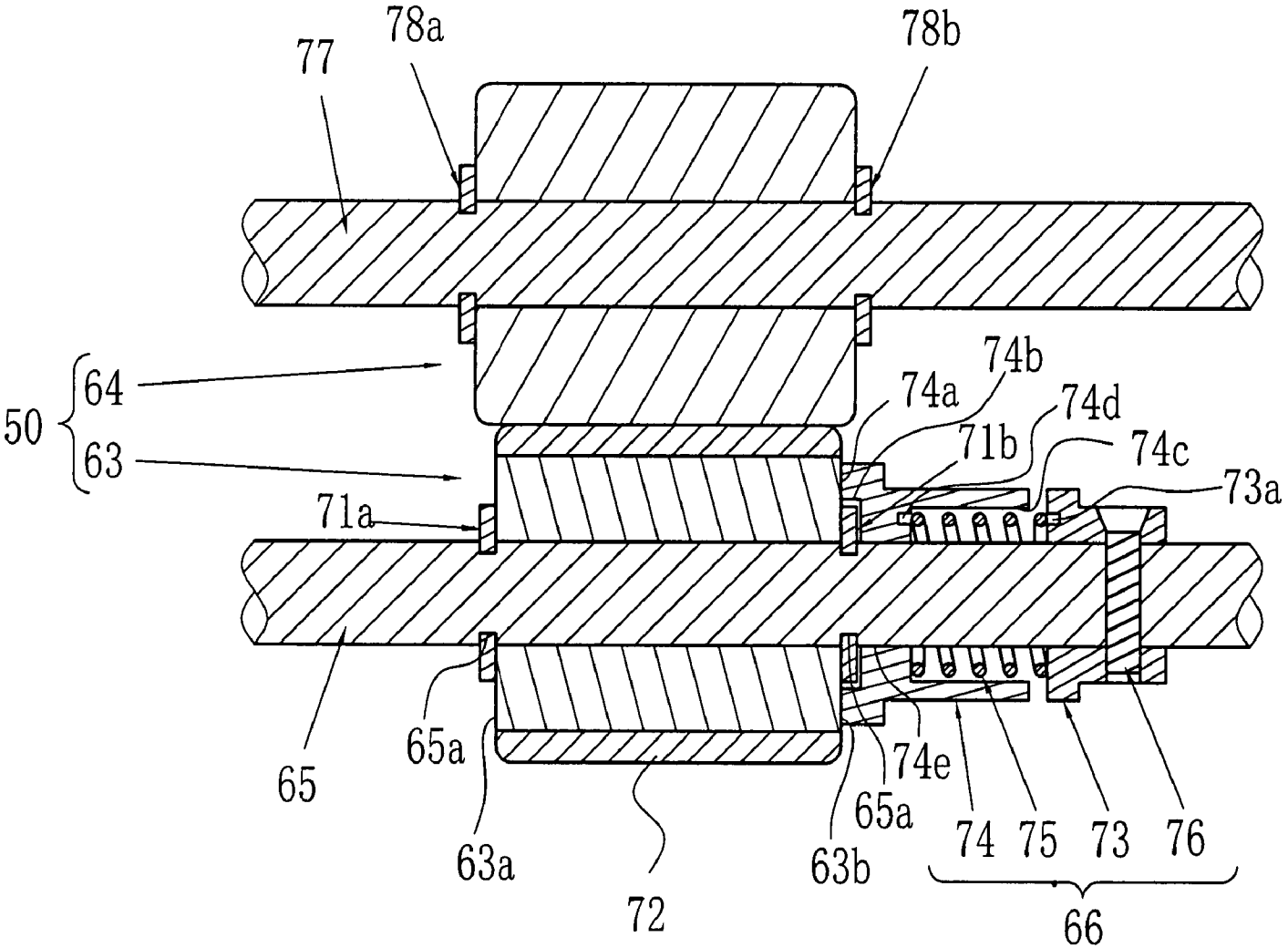
FIG. 6 is a sectional view of a high-speed discharging roller pair including a first embodiment of a feed roller.
Figure 7:
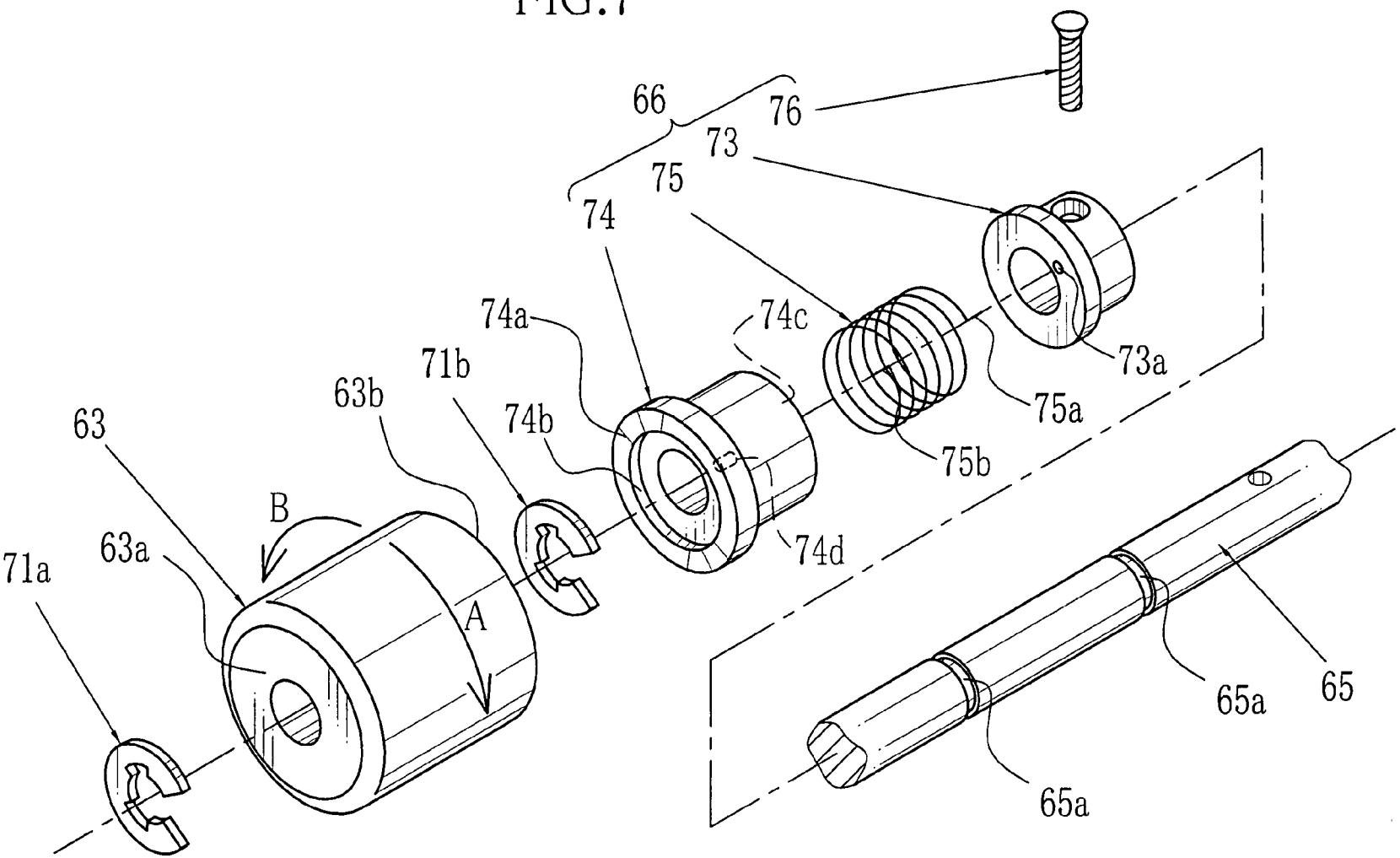
FIG. 7 is a plan view illustrating a structure of a friction juncture section.

As shown in FIGS. 6 and 7, the drive roller 63 is attached to the shaft 65. There are positioning E-rings 71*a*, 71*b* for positioning the drive roller 63 at a position at which the shaft 65 contacts both side surfaces 63*a*, 63*b* of the drive roller 63. The E-rings 71*a*, 71*b* are fitted to grooves 65*a* formed on a periphery of the shaft 65. Thus the shift of the drive roller 63 on the shaft 65 in an axial direction is restrained.

The drive roller 63 is a roller produced from synthesized polymer, and the surface of the drive roller 63 is coated with a rubber coating 72. As the synthesized polymer, there are materials which are excellent in slip properties, abrasion resistance. Such materials are, for example, polyacetal (POM), polyamide (PA), ultra-high-molecular polyethylene (PE-UHMW), polyethylene sulfide (PPS), polytetrafluoroethylene (PTFE) and the like.

The frictional connection unit 66 is constructed of a fixing member 73, a friction member or pad 74, a compression coil spring 75, and a pin 76. The fixing member 73 is formed to have a nearly-pillar like shape, through which the shaft 65 is inserted. Then the fixing member 73 is fixed to the shaft with the pin 76 through which the shaft 65 is inserted.

The friction member 74 is nearly-cylindrically shaped, and coaxially attached to the shaft 65 so as to be slidable in the axial direction. The friction member or pad 74 has a compression contact surface 74*a* which contacts the side surface 63*b* of the drive roller 63. In the middle of the contact surface 74*a*, a notch 74*b* is formed. Further, in an opposite side to the contact surface 74*a*, the friction member 74 has a recess 74*c* continuing to a through hole 74*e* through which the shaft 65 is inserted. Note that the friction member 74 is formed from the same synthesized polymer as the drive roller 63. The notch 74*b* is formed so as to have a diameter for fitting to the E-ring 71*b*.

The coil spring 75 is disposed in the recess 74*c* of the friction member 74, and coiled around the shaft 65. An end 75*a* of the coil spring 75 is firmly inserted in a hole 73*a* of the fixing member 73, and another end 75*b* is firmly inserted in a hole 74*d* formed on a bottom wall of the recess 74*c* of the friction member 74. Thus the coil spring 75 is compressed and attached in this situation to the friction member 74. Accordingly, the slide of the friction member 74 is prevented, and the friction member 74 is biased by the coil spring 75 to press the drive roller 63.

When the drive roller 63 rotates in a rotary direction A (see FIG.7) so as to convey the sheet 15, 16, the friction member 74 presses the drive roller 63 such that the shaft 65 and the drive roller 63 may rotate at the same rotational speed.

When a force of more than a predetermined value is applied to the drive roller to rotate in a direction B (see, FIG. 7), there occurs a slippage between the drive roller 63 and the friction member 74 against the bias of the coil spring 75. Accordingly, the drive roller 63 rotates at a smaller rotational speed than the shaft 65.

The same number of the nip rollers 64 is coaxially and rotatably attached to a metallic shaft 77 as the drive rollers 63 on the shaft 65, and the nip rollers 64 respectively contact the drive rollers 63. On the both sides of the nip roller 64, E-rings 78*a*, 78*b* are provided, so as to restrain the shift of the nip roller 64 on the shaft 77. Both ends of the shaft 77 are respectively supported by side plates 41, 42.

As the nip roller 64 contacts the drive roller 63, the nip roller 64 rotates corresponding to the rotation of the drive roller 63. Accordingly, the sheet 15, 16 is nipped by the drive roller 63 and the nip roller 64 in the high speed discharging roller pair 50, and when the drive roller is driven to rotate in the direction A, then the sheet 15, 16 is discharged through the exit 47 at high speed.

In FIG. 4, the secondary path 45 divides from the primary path 44 at a path exchanger 79, and extends toward the exit 48. The secondary path 45 is provided with plural conveying roller pair 80 between the path exchanger 79 and the exit 48. The conveying roller pair 80 is arranged in line on the secondary path 45. The conveying roller pair 80 has the same structure as the conveying roller pair 49. As shown in FIG. 5, plural timing pulleys 81 are firmly provided on one end of each shaft to which drive rollers of the conveying roller pairs 80 are attached. A timing belt 83 surrounds and contacts the plural timing pulleys 81, a pinion integrally formed with the drive shaft 82. Further, the drive shaft 82 is connected with the motor 62 in the same manner as the drive shaft 59. Accordingly, the drive force of the motor 62 is transmitted to rotate the drive shaft 82, and then the rotation of the drive shaft 82 is transmitted through the timing belt 83 to simultaneously rotate the drive rollers.

The path exchanger 79 effectively exchanges the conveying path between the normal and secondary paths 44, 45, when a guide member 84 of the path exchanger 79 is driven by a solenoid 85. The guide member 84 has a first guide surface 84a for guiding to the primary path 44 and a second guide surface 84*b* for guiding to the secondary path 45.

When the small or middle size sheet 15, 16 dried in the dryer 19 is supplied through the entrance 46 into the sorting device 36, the small or middle size sheet 15, 16 is guided to the primary path 44. When the large size sheet 17 is supplied through the entrance 46 into the sorting device 36, the large size sheet 17 is guided to and conveyed on the secondary path 45. Thereafter, the large size sheet is discharged through the exit 48, and gathered in a stacking tray 126 fixed to the processor section 4.

The small or middle size sheet 15, 16 conveyed in the primary path 44 from the sorting device 36 is discharged from the exit 47 to the reversibly conveying device 37 by the high speed discharging roller pair 50. The reversibly conveying device 37 is disposed next to the exit 47, and constructed of a receiver unit 86 and a conveyer unit 88 so as to reverse the sheet 15, 16 between front and rear surfaces thereof.

The receiver unit 86 has a wide endless belt 90 and first and second rollers 92, 94. The first and second rollers 92, 94 contact to an inner side of the endless belt 90. The first rotational roller 92 has a relatively small diameter. The first roller 92, whose both ends are rotatably supported, is disposed in an upstream side in the conveying direction C of the reversibly conveying device 37. Further, the second roller 94 has a relatively large diameter, and rotatably disposed in another side of the first roller 92, namely in a downstream side in the conveying direction C. Accordingly, when the first and second rollers 92, 94 rotate, the endless belt 90 shifts on the loop to convey the supplied sheet 15, 16 in the conveying direction C perpendicular to the conveying direction in the sorting device 36.

Both ends of the second roller 94 are rotatably supported by a frame (not shown) of the reversibly conveying device 37. One of the ends is protruded on an outer surface of the frame, and connected with a drive motor (not shown) as a source of a drive force. As the drive motor, there is a pulse motor whose rotational speed is controlled by the system controller 38. Thus the rotation of the motor is transmitted through the second roller 94 to the endless belt supported by the first and second rollers 92, 94, and the endless belt 90 shifts around on the loop formed with support of the first and second rollers 92, 94.

The pulse motor used as the drive motor is, for example, a type which is a changeable variation of a phase excitation type, and rotates 0.9 degree of angle per one pulse.

The conveyer unit 88 includes plural thin and narrow belts 102, 104, 106, 108 which are arranged. These plural belts 102, 104, 106, 108 (whose number is four in this embodiment) are supported by first-third rollers 110, 112, 114. The first roller 110 is disposed in right and upper side from the second roller 94 of the receiver unit 86, the second roller 112 is disposed in a left and lower side from the second roller 94, and the third roller 114 is disposed in a lower side from the first roller 92 of the receiver unit 86 at the exit of the sorting device 36.

The first roller 110 has a shaft 118 whose both ends are supported with the frame. Crown rollers are firmly fitted in respective grooves which are formed on a periphery of the first roller 110 at positions corresponding to the four belts 102, 104, 106, 108. Thus the crown rollers rotate at the same rotational speed of the shaft 118. Further, the second and third rollers 112, 114 have respective shafts 120, 122 supported with the frame and crown rollers at positions corresponding to the belts 102, 104, 106, 108 on the shafts 120, 122. The crown rollers are fixed to the shafts 120, 122, so as to rotate at the same rotational speed of the shafts 120, 122.

Each of the belts 102, 104, 106, 108 forms a loop around on the supporting first-third rollers 110, 112, 114. Each belt 102, 104, 106, 108 is pressed to contact to the first roller 110 such that the each belt 102, 104, 106, 108 turn about 180 degrees with the center of the first roller 110. Thereafter, the each belt turns to an opposite direction with the contact to the third roller 114, and then contacts to the second roller 112 to be bent towards the first roller 110 for an endless form. Thus the conveying path of the sheet 15, 16 is constructed.

When the sheet 15, 16 is discharged through the exit 47 to the reversibly conveying device 37, the endless belt 90 of the receiver unit 86 continuously moves around. Therefore, the discharged sheet 15, 16 is positioned on the moving endless belt 90, and conveyed. Thus the sheets 15, 16 discharged from the sorting device 36 are arranged in one row and sequentially conveyed in the conveying direction C. Then the sheets 15, 16 are sandwiched between the endless belt 90 and each belt 102, 104, 106, 108, and discharged from the upper to the lower side of the second roller 94. Thus the sheets 15, 16 are turned over. Thereafter, the sheet is conveyed on the belts 102, 104, 106, 108 in the direction B, and supplied through a space between the first roller and the third roller 114 to a tray 124 of the sorter 26.

The sorter 26 in which the sheets 15, 16 are supplied from the reversibly conveying device 37 has plural trays 124 which are attached to a shifting means for shifting around on a loop. The trays 124 are sequentially shifted downward from the receiving position at the exit of the reversibly conveying device 37, and turned at the lowermost position to shift to the receiving position. The small or middle size sheets 15, 16 are discharged through the exit between the first roller 92 and the roller 114, and received by the tray 124 positioned at a receiving position in the lower side of the exit. When the supply of the small or middle size sheets 15, 16 of the one print order on the tray 124 is completed, a sort signal is generated, and the tray 124 is shifted downward for one stage, and another empty tray 124 is shifted from an upper side to the receiving position so as to make a preparation for receiving the small or middle size sheets 15, 16 of the another print order. The small or middle size sheets 15, 16 disposed on the tray 124 after the completion of the supply thereof are removed from the tray 124 by an operator while the tray 124 is shifted to an lowermost position.

The operation of the above structure will be explained now. Note that the middle size sheet 16 is taken as an example in the following explanation. When the explanation of the small or large size sheet 15, 17 is necessary, they are taken an example.

The printer processor is turned on, and the operator inputs image recording information, such as image data of images to be printed on the recording paper 11, the print size, the number of photo prints and the like. Then a print start button is pressed to start the recording processes of the image on the paper 11. Then, the paper 11 is drawn from the magazine 5, and cut by the cutter 7 to produce the middle size sheet 16. Then the middle size sheet 16 is conveyed sequentially through the back printer 8 and the exposure device 9, in which the printing on the rear surface and the exposure of the printing surface of the sheet 16 are respectively made. After the print on the rear and recording surfaces is completed, the sheet 16 is conveyed to the sheet dispenser 10.

In the sheet dispenser 10, the sheets 16 are arranged in zigzag in two rows on the basis of predetermined dispensing pattern, and further conveyed in this arrangement to the development device 18 and the dryer 19.

In the development device 18 and the dryer 19, the developing treatment and the drying treatment of the sheet 16 are made. Thereafter, the sheet 16 is conveyed to the sheet discharging apparatus 25. In the sheet discharging apparatus 25, as mentioned above, the sheet 16 is conveyed in the primary path 44 and discharged through the exit 47 to the endless belt 90. The process for discharging the sheet 16 from the primary path 44 to the endless belt 90 is explained in reference with FIGS. 8A–8C.

Figure 8A:
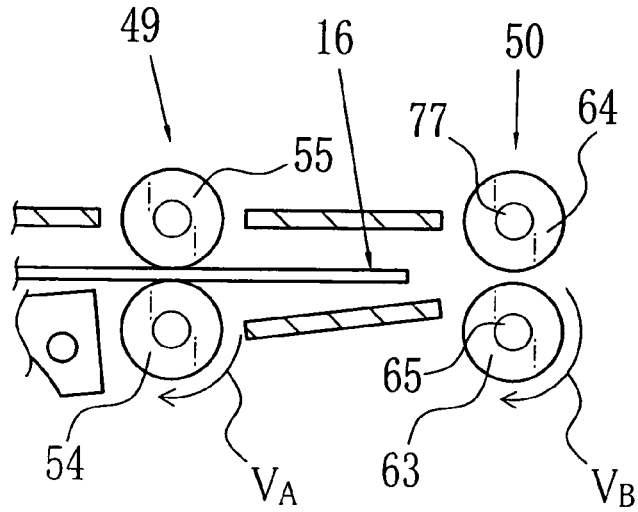
FIG. 8A is an explanatory view illustrating a situation when the sheet is conveyed toward the high speed discharging roller pair.
Figure 8B:
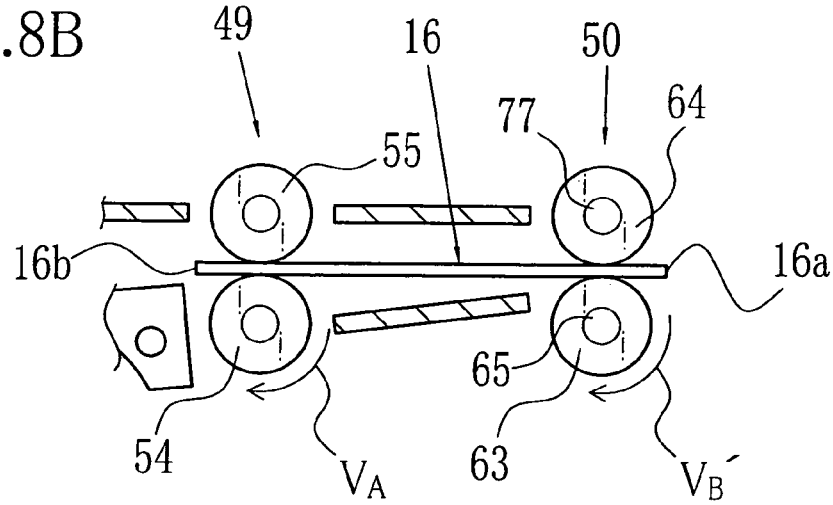
FIG. 8B is an explanatory view illustrating a situation when the front end of the sheet is nipped by the high-speed discharging roller pair.

As shown in FIG. 8A, the sheet 16 is conveyed with the conveying roller pair 49 at the conveying speed $V_A$ in accordance with the rotation of the conveying roller pair 49. In the high speed discharging roller pair 50, it is to be noted that the shaft 65 and the drive roller 63 are firmly coupled by friction via the frictional connection unit 66, so as to rotate together. The discharging speed of the high speed discharging roller pair 50 is $V_B$ ($>V_A$). The sheet 16 conveyed to the high speed discharging roller pair 50 is nipped with the drive roller 63 and the nip roller 64. As shown in FIG. 8B, a front edge 16*a* of the sheet 16 is nipped with the high speed discharging roller pair 50. Thereby as a rear edge 16*b* of the sheet 16 is nipped, the sheet 16 is tensed toward the rear edge 16*b* at a tension force which is larger than a predetermined value. Accordingly, the tension force is transmitted to the drive roller 63 so as to rotate in the direction opposite to the rotational direction. Thus the drive roller 63 slips on the frictional connection unit 66. Accordingly, the drive roller 63 rotates at the lower rotational speed $V_B'$ than the rotational speed $V_B$, ($V_B'<V_B$), and the difference between the conveying speed of the conveying roller pair 49 and the discharging speed of the high speed discharging roller pair 50 is eliminated to discharge the sheet 16 sequentially.

Figure 8C:
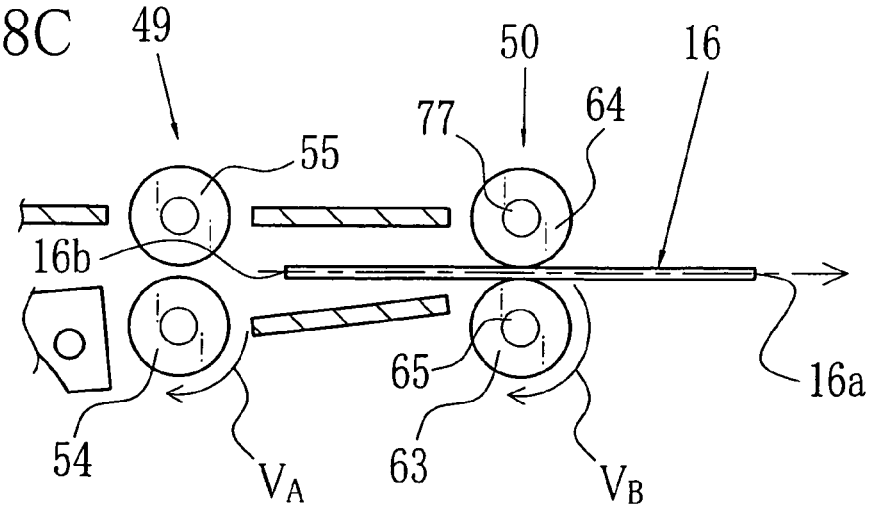
FIG. 8C is an explanatory view illustrating a situation when the sheet is discharged.

As shown in FIG. 8C, when the rear edge 16*b* of the sheet 16 leaves the conveying roller pair 49, the tension force is not applied to the drive roller 63 of the high speed discharging roller pair 50. Accordingly, the drive roller 63 does not slip on the frictional connection unit 66, and rotates with the shaft 65 at the same discharging speed $V_B$. As the drive roller 63 is driven to rotate, the sheet 16 is discharged horizontally at the high discharging speed through the exit 47 to the endless belt 90. Thereafter, the next sheet 16 conveyed in another row is discharged at a predetermined interval. Thus the following sheets 16 are discharged in the order of the zigzag arrangement, and then conveyed in one row on the endless belt 90 and the belts 102, 104, 106, 108 toward the tray 124 of the sorter 26. In the sorter 26, the sheets 16 are sequentially overlaid and gathered on the one tray 124 for each print order.

As the frictional connection unit 66 is provided between the drive roller 63 and the shaft 65 that constructs the high speed discharging roller pair 50, the difference between the conveying speed of the conveying roller pair 49 and the discharging speed of the high speed discharging roller pair 50 is eliminated, and the sheet 16 is discharged with the stable nip force. Further, as the part for elimination of the difference is only the frictional connection unit 66, the cost can be decreased. If the conveying roller pair 49 is provided with a one-way clutch, several types of the one-way clutches are used in accordance with the length of the sheets, and therefore the cost becomes higher.

Further, the frictional connection unit 66 is provided coaxially with the drive roller 63 and the shaft 65, and has a simple structure for transmitting the drive force. The number of parts of the frictional connection unit 66 is small, and therefore the cost for producing the frictional connection unit 66 is low. Furthermore, the drive roller 63 and the friction member 74 are formed of synthetic polymers, and the load by the slippage between the two members can be easily calculated from the biasing force, applied by a biasing member, and the frictional coeffcients of both synthetic polymers. Further, while the bias pressure is calculated from the contact area of the synthetic polymer and the biasing force applied by the biasing member, the upper limit of abrasion in slip can be estimated from the multiple (PV value) of the averaged speed and the bias pressure. Thus when a predetermined load is applied, the frictional connection unit 66 is effective to discharge the sheet sequentially. If a torque limiter of the magnetic sand type is used instead of the frictional connection unit 66, then the cost for production becomes higher. Further, the torque limiter slips when the sheet is discharged. In this case, high endurance is necessary. Furthermore, when the endurance is near the limit thereof, the load of the slip varies so much. Therefore the sheet 16 cannot be discharged sequentially. Further, since there is a difference in the limits of endurance between components of the torque limiter, it becomes extremely difficult to maintain stability of the discharging.

Further, in the above embodiment, as the nip roller 64 of the high speed discharging roller pair 50 rotates in accordance with the rotation of the drive roller 63, the nip roller 64 has a simple structure, and therefore the cost can become lower.

Figure 9:
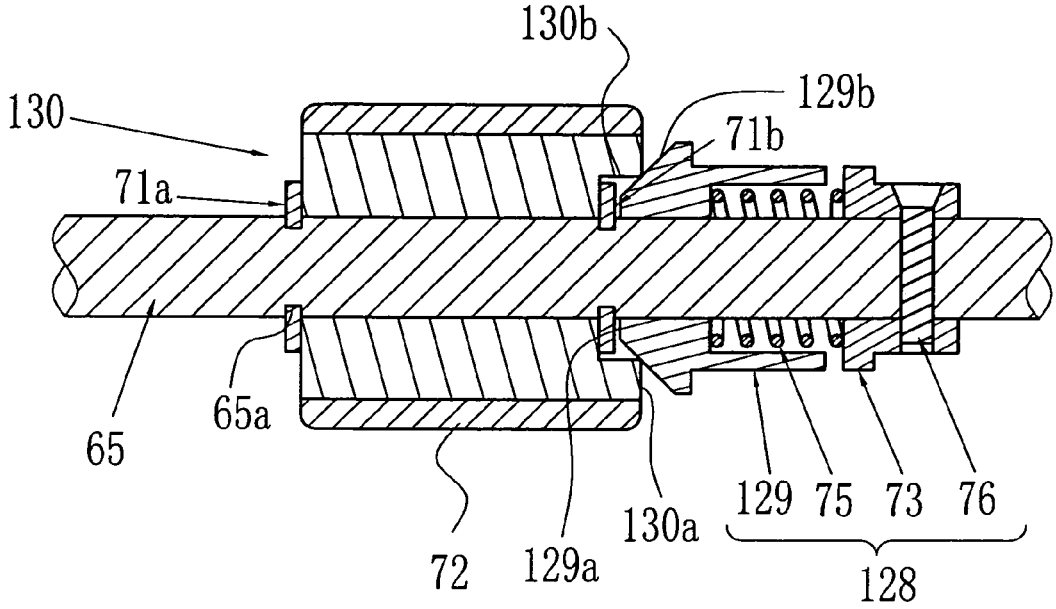
FIG. 9 is a sectional view of a second embodiment of a feed roller.
Figure 10:
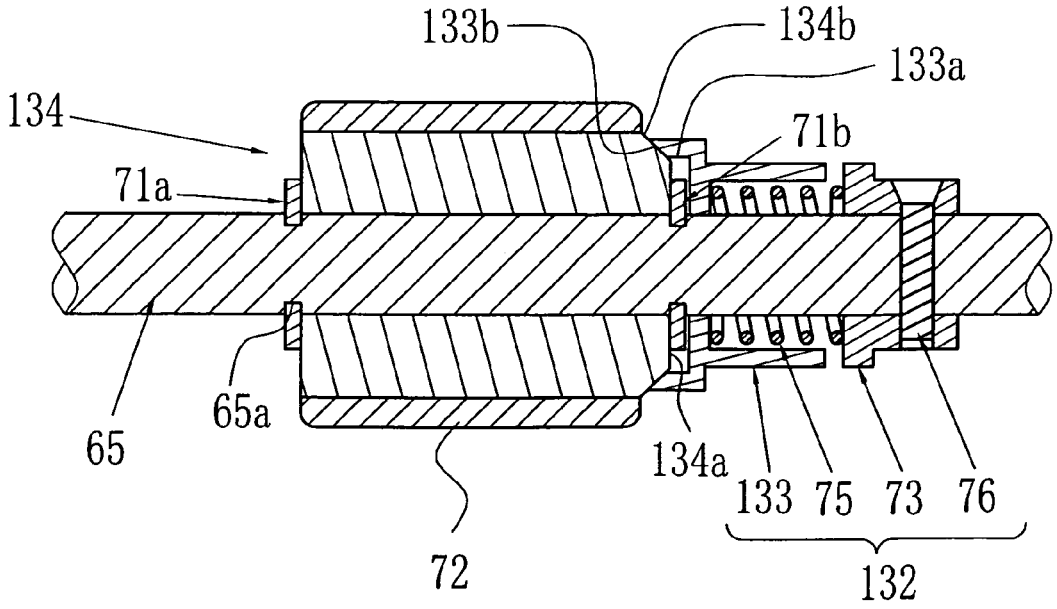
FIG. 10 is a sectional view of a third embodiment of a feed roller.

Note that the shape and the form of the drive roller and the frictional connection unit that form the high speed discharging roller pair are not limited to the above embodiment. For another embodiment, see FIGS. 9 and 10. In FIGS. 9, 10 the same members and parts have the same numerals as the above embodiment, and the explanations thereof are omitted. In a frictional connection unit 128 illustrated in FIG. 9, a tip 129*a* of the friction member or pad 129 has a taper surface 129*b*. The taper surface 129*b* is formed to have a constant inclination to an axis of the drive roller 130. Further, one side 130*a* of the drive roller 130 has a recess 130*b* so as to accept the top of the tapered portion of the friction member 129. The diameter of the recess 130*b* is smaller than the outer diameter of the taper surface 129*b*. As the frictional connection unit 128 and the drive roller 130 have such structure, the friction member 129 biased by the coil spring 75 presses the outer edge of the recess 130*b*. Accordingly, the friction member 129 and the drive roller 130 are more effectively coupled with the friction by the larger pressure. When the larger load of the rotation is applied, the slip occurs between the friction member 129 and the drive roller 130. The embodiment of FIG. 9 is adequate for the case when the specifically large load of the rotation is applied.

Further, a frictional connection unit in FIG. 10 has a friction member or pad 133, and a cylindrical recess 133*a* is formed in an end of the friction member 133. A top of the wall of the recess 133*a* has a taper surface 133*b* which has a conical inclination to an axis of the drive roller 134 such that the outer edge may be protruded from the inner edge of the wall with an increasing diameter. An edge of a side 134*a* of the drive roller 134 has a taper surface 134*b* so as to contact to the taper surface 133*b* of the friction member 133. According to the structure of the frictional connection unit 132 and the drive roller 134, the taper surface 133*b* of the friction member 133 biased by the coil spring 75 presses the taper surface 134*b* of the drive roller 134. Accordingly, the friction member 133 and the drive roller 134 are more effectively combined with the friction by the larger pressure. When the larger load of the rotation is applied, the slip occurs between the friction member 133 and the drive roller 134. The embodiment of FIG. 10 is adequate for the same case as FIG. 9 when the large load of the rotation is applied. Note that the top of the friction member is inclined at a constant angle to the axis of the drive roller. However, the top may be formed to have an arc-shaped silhouette. As the angle and the form of the inclination can be varied, the pressure can be more freely adjusted with a higher degree of freedom.

In the above embodiment, the photosensitive material drawn from the magazine is cut by the cutter 7 to have a predetermined size. The position of the cutter 7 may be upstream from the sheet dispenser 10, and is not restricted in the above embodiment. Further, the cutting direction of the cutter 7 is a widthwise direction of the photosensitive material, and the print size of the cut sheet depends on the length of convey before cutting. Further, in the above embodiment, the width of the print size in the widthwise direction is changed by selecting one of the plural photosensitive materials which have different widths. However, a slitter may be provided so as to cut the photosensitive material in the conveying direction, and to change the width of the cut recording material. The number of used magazines is not restricted to two, but may be equal to or more than three.

In the above embodiment, the present invention is applied to a device for developing the photosensitive material. However, the present invention may be applied to several types of sheet discharging apparatuses in which sheets in plural rows are conveyed. For example, the present invention may be applied to an ink jet printer, in which the sheet after printing is conveyed and dried in plural rows.

Various changes and modifications are possible in the present invention and may be understood to be within the present invention.

What is claimed is:

1. A sheet discharging apparatus including a conveying means for conveying a sheet on a conveying path, and a high speed discharging means for discharging through an exit of said conveying path, said high speed discharging means being disposed at said exit, and a discharging speed of said high speed discharging means being higher than a conveying speed of said conveying means, said high speed discharging means comprising:

a drive shaft;

a drive roller rotatably and coaxially attached to said drive shaft, said drive roller being unshiftable in an axial direction of said drive shaft;

a frictional connection unit for firmly coupling said drive roller and said drive shaft with frictional force; and a nip roller, idly rotatable, said nip roller nipping said sheet with said drive roller to discharge out said sheet, wherein said frictional connection unit further comprises:

a fixing member fixed to said drive shaft;

a friction member for frictionally contacting an end surface of said drive roller; and a biasing member provided between said fixing member and said friction member, said biasing member pressing said friction member against, and into frictional contact with, said end surface of said drive roller;

wherein said biasing member is a coil spring having a first end and a second end, said first end is fixed to said fixing member, and said second end is fixed to said friction member, and wherein said friction member is provided with a contact portion for contacting said drive roller, and said contact portion is chamfered to have an arc-shape or a linear inclination to an axial direction of said drive roller.

2. A sheet discharging apparatus as claimed in claim 1, wherein said sheet comprises plural sheets, which are conveyed on said path in a situation that said sheets are positioned in zigzag among plural rows, and sequentially arranged in a single row.

3. A sheet discharging apparatus as claimed in claim 2, wherein said drive roller comprises plural drive rollers disposed at an interval in the axial direction of said drive shaft.

4. A sheet discharging apparatus as claimed in claim 3, wherein said nip roller comprises plural nip rollers disposed at an interval on a shaft.

5. A sheet discharging apparatus as claimed in claim 4, wherein each of said drive rollers is positioned on said drive shaft by a pair of E-rings, and each of said nip rollers is positioned on said shaft by a pair of E-rings.

6. A sheet discharging apparatus as claimed in claim 4, further comprising an endless belt disposed downstream from said high speed discharging means, and said endless belt receiving said sheet discharged with said high speed discharging means.

7. A sheet discharging apparatus as claimed in claim 1, wherein said friction member contacts only said end surface of said drive roller.

8. A sheet discharging apparatus including a conveying means for conveying a sheet on a conveying path, and a high speed discharging means for discharging through an exit of said conveying path, said high speed discharging means being disposed at said exit, and a discharging speed of said high speed discharging means being higher than a conveying speed of said conveying means, said high speed discharging means comprising:

a drive shaft;

a drive roller rotatably and coaxially attached to said drive shaft, said drive roller being unshiftable in an axial direction of said drive shaft;

a frictional connection unit for firmly coupling said drive roller and said drive shaft with frictional force; and a nip roller, idly rotatable, said nip roller nipping said sheet with said drive roller to discharge out said sheet, wherein said frictional connection unit further comprises:

a fixing member fixed to said drive shaft;

a friction member for frictionally contacting an end surface of said drive roller; and a biasing member provided between said fixing member and said friction member, said biasing member pressing said friction member against, and into frictional contact with, said end surface of said drive roller; and wherein said friction member is provided with a contact portion for contacting said drive roller, and said contact portion is chamfered to have an arc-shape or a linear inclination to an axial direction of said drive roller.

* * * * *